US009174140B2

(12) United States Patent
Nelson et al.

(10) Patent No.: US 9,174,140 B2
(45) Date of Patent: Nov. 3, 2015

(54) BALLOON INFLATOR

(75) Inventors: David C. Nelson, Akron, OH (US); Wesley A. Schroeder, Seville, OH (US); Marcus Jahrling, Southend on Sea (GB)

(73) Assignee: Premium Balloon Accessories, Inc., Sharon Center, OH (US)

( * ) Notice: Subject to any disclaimer, the term of this patent is extended or adjusted under 35 U.S.C. 154(b) by 867 days.

(21) Appl. No.: 13/293,230

(22) Filed: Nov. 10, 2011

(65) Prior Publication Data

US 2013/0118636 A1 May 16, 2013

(51) Int. Cl.
*B65B 3/16* (2006.01)
*A63H 27/10* (2006.01)

(52) U.S. Cl.
CPC ..... *A63H 27/10* (2013.01); *A63H 2027/1033* (2013.01)

(58) Field of Classification Search
CPC ..... A63H 2027/1033; A63H 2027/1083
USPC ..... 141/38, 388, 114, 313–315; 53/79, 469; 446/220; 137/223; 20/38, 388, 114, 20/313–315
See application file for complete search history.

(56) References Cited

U.S. PATENT DOCUMENTS

| | | | | |
|---|---|---|---|---|
| 3,692,071 | A * | 9/1972 | Begleiter | 141/313 |
| 4,586,456 | A * | 5/1986 | Forward | 116/210 |
| 6,634,394 | B1 * | 10/2003 | Nelson et al. | 141/114 |
| 7,147,016 | B1 * | 12/2006 | Nelson et al. | 141/114 |
| 2006/0272732 | A1 * | 12/2006 | Lighter | 141/38 |
| 2009/0260710 | A1 * | 10/2009 | Huval et al. | 141/38 |

* cited by examiner

*Primary Examiner* — Jason K Niesz
(74) *Attorney, Agent, or Firm* — Renner Kenner Greive Bobak Taylor & Weber

(57) ABSTRACT

A balloon inflator includes a tank containing a volume of pressurized gas and a regulator assembly removably secured to the tank for reducing the pressure of gas exiting the tank, the regulator assembly including a pressure regulator. A nozzle assembly is also provided and includes a valve for controlling dispensing of the pressurized gas. A flexible hose extends between the regulator assembly and the nozzle assembly, the hose being in fluid communication with the pressure regulator and the valve. The balloon inflator is small and lightweight, and therefore portable and concealable. The flexible nature of the hose allows for easy manipulation of the nozzle assembly, making use of the balloon inflator easier for performers.

10 Claims, 5 Drawing Sheets

BALLOON INFLATOR

FIELD OF THE INVENTION

The present disclosure relates generally to balloon inflators. More particularly, the present disclosure relates to a portable, pressurized tank-based balloon inflator. The balloon inflator is able to fill various balloons, but in particular embodiments is intended to fill modeling balloons.

BACKGROUND OF THE INVENTION

The use of balloons as decorations for parties, celebrations, grand openings, and other events is well known, and millions of balloons are so used each year. In many instances, performers use balloons for entertainment purposes. For example, balloon artists, known in the industry as "twisters," create shapes and animals from "modeling" balloons specifically designed for that purpose. Modeling balloons are long and have a small diameter, but are very strong and resilient in order to withstand all the twisting. Only individuals with extremely strong lungs can generate the air pressures necessary to blow up modeling balloons (and particularly those of high quality), and it is therefore helpful, and sometimes necessary, to inflate them using a balloon inflation device or "balloon inflator". Many varieties of balloon inflators are known and commercially available, but these inflators suffer from a number of disadvantages, particularly where the performer moves about during the performance, making portability an issue.

Prior art balloon inflators capable of generating the pressures necessary for inflating a modeling balloon are motor based, typically employing a motor to power an air compressor or a pump. The motors, compressors and/or pumps make these balloon inflators heavy and cause them to become hot while operating. In addition, motor-based balloon inflators can be somewhat large and awkward in size, making them cumbersome and difficult to carry. Furthermore, prior art balloon inflators may overheat if used or run continuously. All of these factors weigh against easy portability. The prior art portable modeling balloon inflators rely upon batteries for power. Batteries are a burden because they must be recharged or replaced when they no longer provide sufficient power. They also suffer from requiring frequent replacement, especially during frequent use. These battery powered devices often also suffer from electrical complications.

A particular prior art balloon inflator that is commercially available utilizes a compressor similar to those used in automobile horns to inflate modeling balloons. This compressor is not designed for continuous use, but instead is designed for use in short durations, and is therefore not ideally suited for use as a balloon inflator. In addition, the compressor is typically powered by a nickel cadmium battery or lead-acid battery, which are both heavy and expensive. Therefore, this popular balloon inflator suffers from a number of disadvantages.

Thus, there is a need for an improved portable balloon inflator device that alleviates one or more of the deficiencies discussed above. Notably, although this need relates most specifically to modeling balloons, the balloon inflators taught herein can generally inflate any type of balloon.

SUMMARY OF THE INVENTION

In general, a balloon inflator according to the present disclosure includes a tank containing a volume of pressurized gas; a regulator assembly removably secured to said tank for reducing the pressure of gas exiting the tank, the regulator assembly including a pressure regulator; a nozzle assembly including a valve for controlling dispensing of the pressurized gas; and a hose extending between said regulator assembly and said nozzle assembly, said hose being in fluid communication with said pressure regulator and said valve.

In other embodiments, a balloon inflator of this invention includes a tank containing a volume of pressurized gas and including a valve assembly having a valve and a first pressure regulator for reducing the pressure of gas leaving said tank; a regulator assembly removably secured to said tank for reducing the pressure of gas exiting the tank, the regulator assembly including a second pressure regulator; a nozzle assembly including a valve for controlling dispensing of the pressurized gas, a nozzle for dispensing pressurized gas, and a housing positioned around said valve and said nozzle; and a flexible hose in fluid communication with said second pressure regulator and said valve.

Yet other embodiments of this invention provide a method of "magically" inflating a balloon using a balloon inflator. This method includes the steps of securing a tank and regulator assembly of the balloon inflator to an article worn by a user; positioning a hose of the balloon inflator beneath the clothes of the user; securing a nozzle assembly of the balloon inflator in or adjacent to a hand of the user; positioning an open end of a balloon over a nozzle of the nozzle assembly while keeping the presence of the nozzle assembly hidden; pressing an actuating button on the nozzle assembly to release a volume of pressurized gas into the balloon; and tying the balloon closed without revealing the nozzle assembly.

BRIEF DESCRIPTION OF THE DRAWINGS

For a full understanding of the apparatus and methods of the present disclosure reference should be made to the following detailed description and the accompanying drawings, wherein.

DETAILED DESCRIPTION OF THE ILLUSTRATIVE EMBODIMENTS

Figure 1:
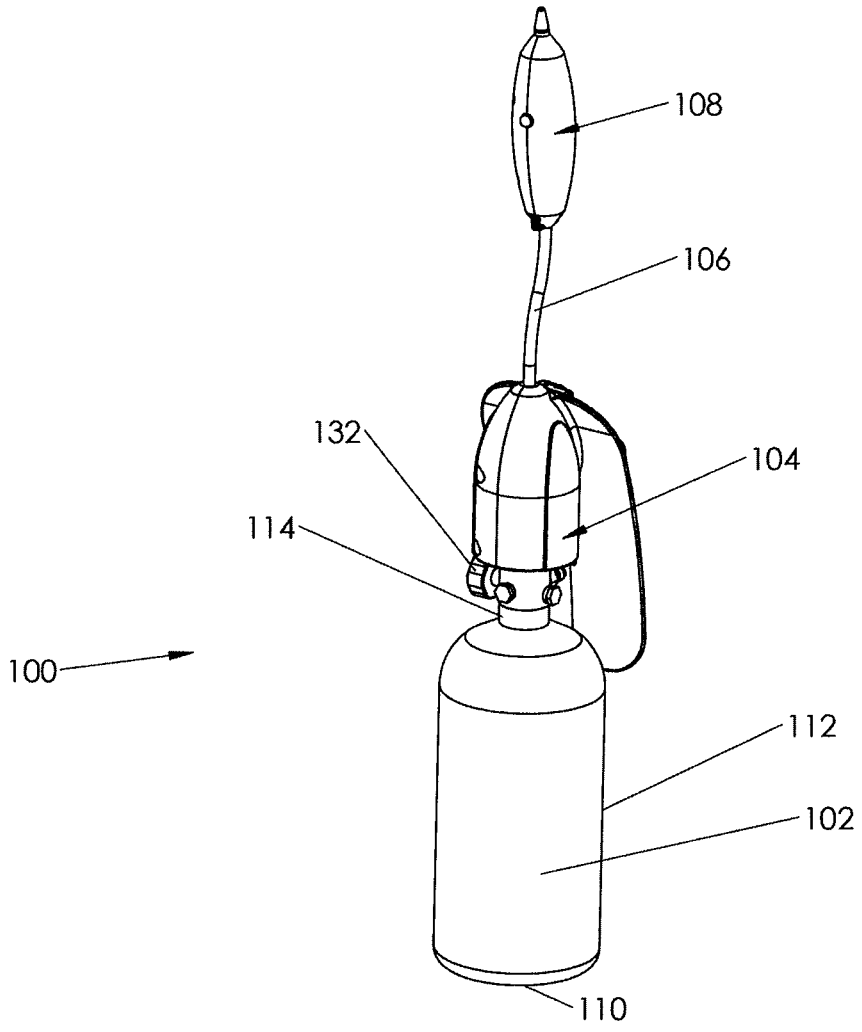
FIG. 1 is a perspective view of a balloon inflator according to the concepts of the present disclosure.
Figure 2:
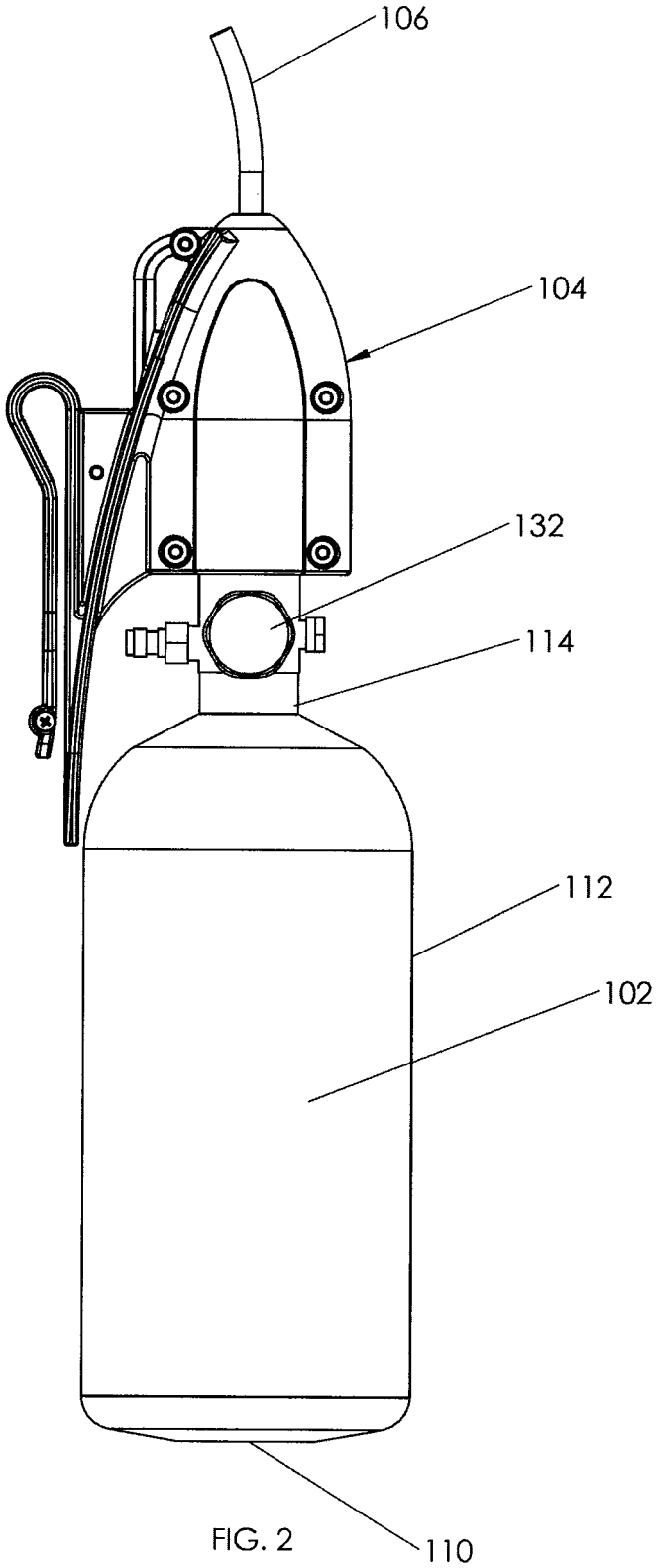
FIG. 2 is a side view of a tank, regulator assembly, and a portion of a hose extending from the regulator assembly according to the concepts of the present disclosure.
Figure 3:
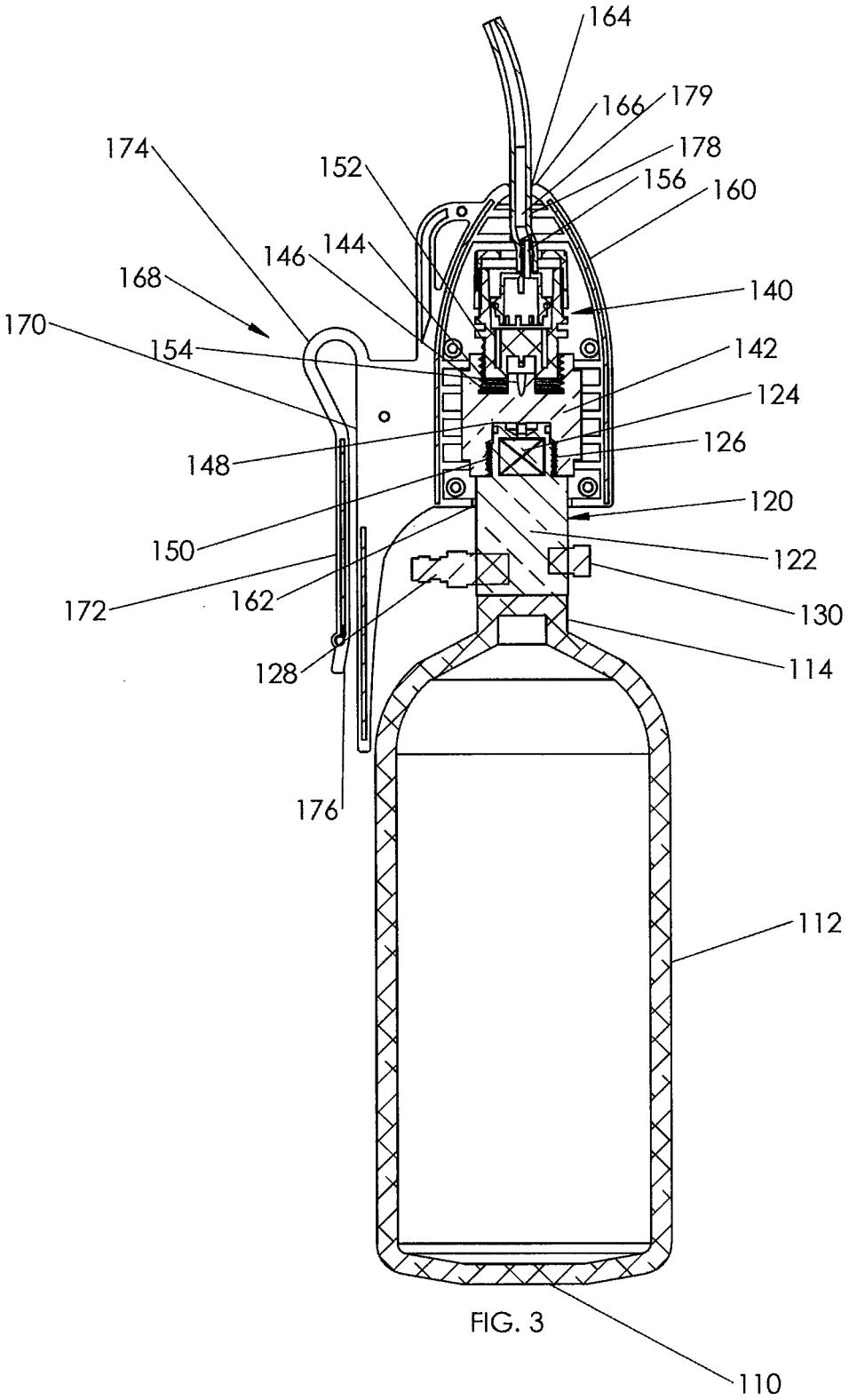
FIG. 3 is a section view of the tank, the regulator assembly, and the portion of the hose extending from the regulator assembly as shown in FIG. 2.

With reference to FIGS. 1-5, it can be seen that a balloon inflator according to this disclosure is designated generally by the numeral 100. Balloon inflator 100 includes a tank 102, a regulator assembly 104, a hose 106, and a nozzle assembly 108. The hose 106 extends between regulator assembly 104 and nozzle assembly 108 to transmit pressurized gas therebetween. The hose 106 can be of any desired length. The balloon inflator is small in size and is powered by pressurized gas within the tank 102. Notably, the balloon inflator 100 is devoid of a motor, devoid of an air compressor or air pump, and is devoid of batteries, which were necessary in the prior art to power the motors, compressors and/or pumps. The balloon inflator 100 is most preferably portable. The hose 106 and nozzle assembly 108 make the balloon inflator 100 easy to use, even for performers using the device during a performance.

The tank 102 of balloon inflator 100 contains a volume of pressurized gas suitable for filling balloons. The gas may be any desired gas, and will typically be selected based upon the intended use. The most typically gases are air and helium. Tank 102 may be generally cylindrical in shape, and includes a bottom surface 110, a sidewall 112, and a neck portion 114. In certain embodiments, bottom surface 110 may be generally planar for providing a suitable surface for the tank 102 to rest upon. While a generally cylindrical tank is shown in the drawings and described herein, it is also contemplated that tanks having various other sizes and shapes may be utilized with the balloon inflator of the present disclosure.

A valve member 120 (FIG. 3) is secured to tank 102 at neck portion 114 to fluidly communicate with the pressurized content therein. Valve member 120 includes first stage regulator 122 and a valve 124. In certain embodiments, valve member 120 may be provided as an integral part of tank 102. First stage regulator 122 reduces the pressure of pressurized gas leaving tank 102. First stage regulator 122 may be any suitable regulator known to those skilled in the art. For example, the regulator may include a piston regulator and a spring biasing the piston, where pressure acting on the exposed surface area of the piston is balanced by the spring force. Valve 124 controls the release of pressurized gas from tank 102. The valve 124 may be any suitable valve known to those skilled in the art. In certain embodiments, valve 124 may be a standard ASA pin valve having external threads 126 on an exterior surface consistent with ASTM F-1750.

In one or more embodiments, valve member 120 may also include one or more additional ports and/or gauges, as will be appreciated by those skilled in the art. For example, valve member 120 may include a fill valve 128 fluidly communicating with the internal volume of the tank 102 for optionally refilling the tank 102 with pressurized gas when the tank is empty or the pressure of the gas therein is reduced below a useful pressure. In addition, a safety plug 130 fluidly communicating with the internal volume of the tank 102 may optionally be provided to allow release of gas and pressure if a dangerous internal pressure is reached within the tank. A pressure gauge 132 (FIG. 2) can fluidly communicate with the contents of tank 102 for determining the pressure within the tank 102 and/or the approximate amount of pressurized gas remaining within tank 102. In certain embodiments, an on/off valve may also be provided to selectively control the flow of pressurized gas from the tank 102. Such valves are well known to those skilled in the art.

Regulator assembly 104 includes a second stage regulator 140 and an adapter 142 to connect the first and second stage regulators 122 and 140 so that they fluidly communicate with one another. In one or more embodiments, the second stage regulator 140 may be similar in structure and operation to first stage regulator 122. In certain embodiments, the second stage regulator further reduces the pressure of gas flowing from the first stage regulator to a pressure suitable for use in filling balloons.

The adapter 142 is connected to the valve member 120 and the second stage regulator 140. In the embodiment shown in the drawings, the adapter 142 includes a first recess 144 containing internal threads 146 and a second recess 148 containing internal threads 150. Internal threads 146 of first recess 144 mate with external threads 152 provided on a connector portion of the second stage regulator 140. Similarly, the internal threads 150 of second recess 148 mate with the male threads 126 on valve member 120. The adapter 142 also includes a passage 154 there through to allow pressurized gas to move from the valve member 120 through second stage regulator 140. When the regulator assembly 104 is secured to the valve member 120, the valve 124 is actuated by the adapter 142 to allow gas to flow from the tank 102 through the first stage regulator 102, the valve 124, the adapter 142, and the second stage regulator 140.

A gas, now reduced in pressure a second time to a level suitable for inflating balloons, exits second stage regulator 140 at an exit port 156 and flows through the hose 106 to the nozzle assembly 108. The hose 106 is connected to the regulator assembly 104 at the exit port 156 of second stage regulator 140. The hose 106 may have any desired length and diameter suitable for the intended purpose. In addition, the hose 106 may be made of any known material suitable for the intended use. In a preferred embodiment, the hose 106 is flexible in nature so as to allow for maneuverability of the nozzle assembly 108, as will be discussed below. In one or more embodiments, the hose 106 may be made of a natural or synthetic rubber composition.

Regulator assembly 104 further includes a housing 160 that surrounds and protects the components of the regulator assembly 104. Housing 160 includes a first opening 162 adjacent to the second recess 148 to allow the housing 160 and adapter 142 to be received over the valve member 120 and the male threads 126 of tank 102. First opening 162 may be circular in shape to facilitate rotation of the regulator assembly 104 relative to the tank 102. The housing 160 also includes a second opening 164 adapted to allow the hose 106 to extend therethrough. In certain embodiments, the second opening 164 may be positioned opposite the first opening 162. The second opening 164 may also be circular in shape to accommodate the generally cylindrical hose 106, and a radius 166 may be provided on the outer surface of second opening 164 to protect the hose 106 from flexing.

Housing 160 may further include a belt clip 168 either formed integrally therewith or otherwise secured thereto. Belt clip 168 includes a clip surface 170 and a clip arm 172 biased to be in close proximity to the clip surface 170. In some embodiments, as here, it extends generally parallel to the clip surface 170. In one or more embodiments, the clip arm 172 may include a radiused connecting arm 174 extending from an edge of the clip surface 170. As will be appreciated by those skilled in the art, clip arm 172 is capable of flexing relative to clip surface 170 to allow a belt or other article to slide between the clip surface 170 and the clip arm 172 and be wedged therebetween to hold the balloon inflator 100 on such belt or article. In certain embodiments, an angled end portion 176 of the clip arm 172 helps to facilitate clipping of the belt clip 168 to an article by providing a mouth for insertion of such article.

In one or more embodiments, housing 160 may also include one or more hose supports 178 therein that prevent excessive strain from acting on the hose 106. In the embodiment shown in the drawings, hose supports 178 are cross members extending across the internal cavity of housing 160, each hose support 178 having an aperture 179 therethrough that receives a portion of hose 106. The number and spacing of the hose supports 178 may vary as necessary to adequately support the hose 106 based upon the specific design of the housing 160 and the properties of the hose.

Figure 4:
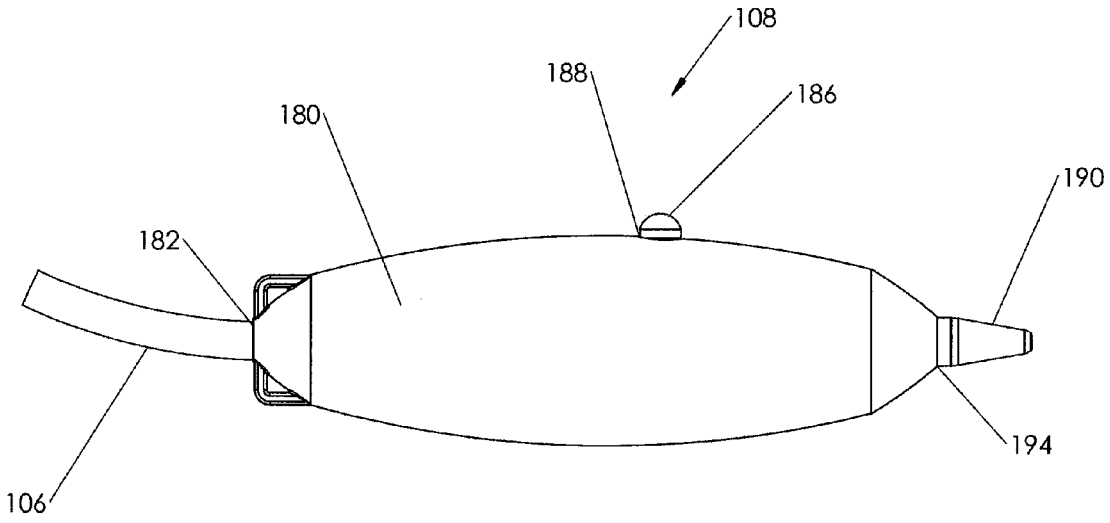
FIG. 4 is a side view of a nozzle assembly and a portion of the hose entering the nozzle assembly according to the concepts of the present disclosure.
Figure 5:
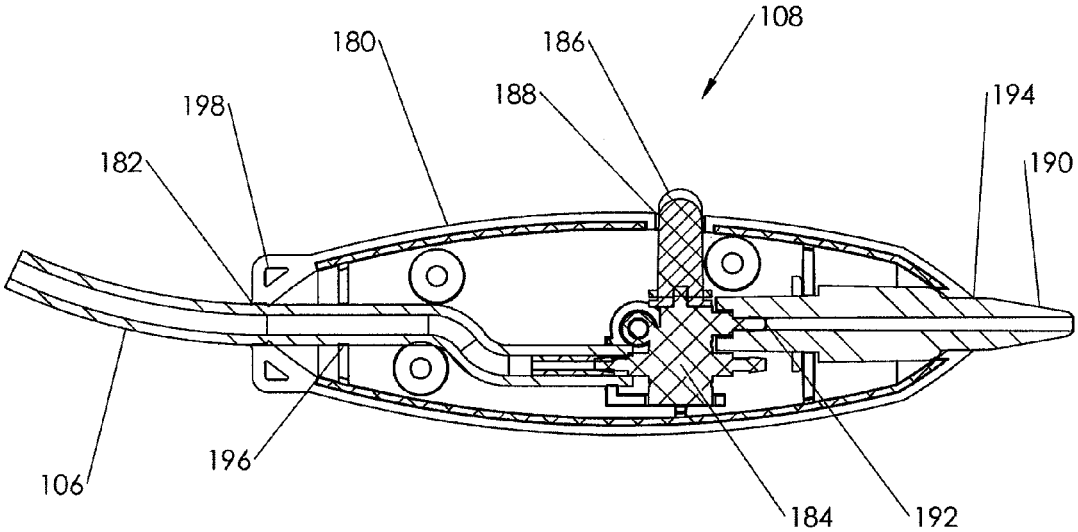
FIG. 5 is a section view of the nozzle assembly of FIG. 4.

Referring to FIGS. 4 and 5, nozzle assembly 108 includes an ergonomic housing 180 that contains and protects the components therein. Housing 180 includes a first opening 182 sized and shaped to receive an end of the hose 106. The hose 106 extends through the first opening 182 and is connected to a valve 184, actuation of which causes pressurized gas to be dispensed from the nozzle assembly 108. Valve 184 includes a valve actuator 186 that allows a user to control opening and closing of the valve 184. In the embodiment shown, the valve actuator 186 is a push button extending through an aperture 188 in housing 180. Valve 184 may be any suitable valve known to those skilled in the art and capable of controlling the flow of pressurized gas from the tank 102 and through the hose 106 and nozzle assembly 108. A nozzle 190 is in fluid communication with an outlet 192 of the valve 184. Nozzle 190 defines a second opening 194 in housing 180, and is sized and shaped to receive a neck portion of a balloon thereon for filling.

The housing 180 of nozzle assembly 108 may also include one or more hose supports 196 adjacent to first opening 182 to alleviate the strain placed upon hose 106. In addition, the housing 180 may include integral loops 198 that allow for attachment of a ring to the nozzle assembly 108. The ring (not shown) attached to the integral loops 198 provides a grip for one or more fingers to allow a user to secure the nozzle assembly 108 within a hand while allowing them to continue to use that hand to manipulate a balloon. While a specific nozzle assembly design has been shown, it will be appreciated by those skilled in the art that various modifications can be made to the nozzle assembly within the scope of the present disclosure.

The tank 102 can be designed with various volumes and pressures, and will be designed with an eye toward the volume of gas it can provide at an appropriate pressure to fill the desired type of balloon. The first and second stage regulators 122, 140 are also taken into account in designing the balloon inflator 100. In one or more embodiments, the tank volume is less than 1500 cubic centimeters, in other embodiments, less than 1250 cubic centimeters, in yet other embodiments, less than 1000 cubic centimeters, and, in yet other embodiments, less than 800 cubic centimeters. In one or more embodiments, the tank volume is greater than 400 cubic centimeters, in other embodiments greater than 500 cubic centimeters, in yet other embodiments, greater than 600 cubic centimeters, and in still other embodiments greater than 700 cubic centimeters.

Within such volume ranges, the tank may be pressurized to various pressures of gas. In one or more embodiments in which the tank is pressurized with gas, such as, for example, air or helium, the pressure of the tank may be greater than 6,894.75 kPa (1,000 psi), in other embodiments greater than 8,000 kPa (1,160.30 psi), in yet other embodiments, greater than 10,000 kPa (1,450.38 psi), and in still other embodiments, greater than 15,000 kPa (2,175.57 psi). In one or more embodiments in which the tank is pressurized with gas (e.g. air or helium), the pressure of the tank may be less than 34,473.80 kPa (5,000 psi), in other embodiments less than 33,000 kPa (4,786.25 psi), in yet other embodiments less than 30,000 kPa (4,351.13 psi), and in still other embodiments less than 25,000 kPa (3,625.94 psi). It is also contemplated that where other gasses are used, such as, for example, carbon dioxide, the pressures within the tank may be higher or lower to prevent the gas from changing phase or for other considerations. For example, where carbon dioxide is used, the pressure of the tank may be approximately 5,515.81 kPa (800 psi).

In one or more embodiments, the first stage regulator reduces the pressure of the gas to less than 10,000 kPa (1,450.38 psi), in other embodiments less than 9,000 kPa (1,305.34 psi), in other embodiments less than 8,000 kPa (1,160.30 psi), in other embodiments less than 7,000 kPa (1,015.26 psi), in other embodiments less than 6,000 kPa (870.23 psi), in other embodiments less than 5,000 kPa (725.19 psi), in still other embodiments less than 4,000 kPa (580.15 psi), and in yet other embodiments less than 3,000 kPa (435.11 psi).

In one or more embodiments, the second stage regulator reduces the pressure of the gas to less than 1,000 kPa (145.04 psi), in other embodiments less than 900 kPa (130.53 psi), in other embodiments less than 800 kPa (116.03 psi), in other embodiments less than 700 kPa (101.53 psi), in other embodiments less than 600 kPa (87.02 psi), in other embodiments less than 550 kPa (79.77 psi), in still other embodiments less than 500 kPa (72.52 psi), and in yet other embodiments less than 400 kPa (58.02 psi).

In certain embodiments, the tank may have a volume of between 400 and 1250 cubic centimeters, and is pressurized with air to a pressure of from 6,894.75 kPa to 34,473.8 kPa (1,000-5,000 psi). In the same or other embodiments, the first stage regulator may reduce the pressure of gas exiting the tank to a pressure that is between 5,000 and 6,000 kPa, and the second stage regulator may further reduce the pressure of gas traveling to the nozzle assembly to between 650 and 750 kPa. In a particular embodiment, the tank may have a volume of approximately 786 cubic centimeters, and is pressurized to a pressure of approximately 20,684.28 kPa (3,000 psi). The first stage regulator may reduce the pressure to approximately 5,515.8 kPa (800 psi), and the second stage regulator may reduce the pressure to approximately 689.48 kPa (100 psi).

The tank and other elements are preferably chosen with an eye toward reduced weight. In one or more embodiments, the entire filled balloon inflator assembly 100 is less than 3.5 kilograms (kg), in other embodiments less than 2.5 kg, in yet other embodiments less than 1.5 kg, and in still other embodiments less than 1.0 kg.

In one or more embodiments, operation of the balloon inflator 100 creates noise having a decibel level of less than 50 dB, in other embodiments less than 40 dB, in yet other embodiments less than 30 dB, and in still other embodiments less than 20 dB. These low decibel levels are not experienced in those balloon inflators employing motors and air compressors, which are notably absent in embodiments of the present invention. Also absent are batteries necessary to operate such motors and air compressors. Though batteries might be employed in embodiments of the balloon inflator of the present invention for adding additional features to the balloon inflator, such as, for example, lights or graphic displays.

As is apparent from the description above, a balloon inflator 100, according to the concepts of the present disclosure is highly portable and is easy to manipulate and use. The belt clip of the regulator assembly housing allows for easy and convenient attachment of the tank 102 and the regulator assembly 104 to a users clothing or belt. In certain embodiments, the size of the tank 102 is chosen to allow for easy concealment of the balloon inflator 100. The flexible hose 106 allows a user to secure the nozzle assembly 108 in a convenient location without concern for the tank 102 and regulator assembly 104. For instance, a user may clip the tank 102 to a belt and run the hose 106 beneath clothing so that the nozzle assembly 108 can be held or "palmed" in a hand without the tank 102, hose 106 and nozzle assembly 108 being visible. The loop 198, and the ring that may be secured thereto, allow a user to continue using two hands to manipulate a balloon without having to set aside or store a nozzle assembly 108.

A method of using the balloon inflator 100 to inflate a balloon will now be described. The balloon inflator 100 may be secured to a users belt or clothing in an area capable of concealment. The hose 106 may be run beneath the users clothing and though a sleeve and the nozzle assembly 108 may be held or positioned in or adjacent to a users hand. The user may hold a balloon with one or both hands and, without letting an audience see, secure the end of the balloon over the nozzle 190 and press the valve actuator 106 to inflate the balloon. Because the tank 102, regulator assembly 104, hose 106, and nozzle assembly 108 all remain hidden from view, the inflation of the balloon may be made to look like "magic." Release of the valve actuator 186 will close valve 184 to stop pressurized gas from flowing from tank 102. The user may then tie the balloon and manipulate the balloon as necessary with the nozzle assembly 108 being secured in or near the users hand by a ring secured to the loops 198. Of course, hiding the hose and nozzle is not required.

As is apparent from the above description, a balloon inflator as described herein does not require a motor or pump, and therefore does not require an electric cord or batteries. Accordingly, the balloon inflator makes less noise, does not generate heat, and is smaller in size than conventional balloon inflators. In addition, a balloon inflator as described herein may be easily hidden and manipulated due to the inclusion of the hose and separate nozzle assembly. The tank of the balloon inflator may be easily refilled if desired, or replaced with a full tank if refilling is not convenient.

It is thus evident that a balloon inflator constructed as described herein substantially improves the art. Only particular embodiment(s) have been presented and described in detail, and the invention should not be limited by the drawings or the description provided. For an appreciation of the true scope and breadth of the invention, reference should be made only to the following claims.

The invention claimed is:

1. A body-worn balloon inflator comprising:

(a) a tank containing a volume of pressurized gas and including a valve assembly having a first valve and a first pressure regulator for reducing the pressure of gas leaving said tank; and a (b) a tank receiver separate and distinct from said tank and valve assembly, said tank receiver including:

(1) a regulator assembly including a second pressure regulator, a regulator assembly housing, and a belt clip extending from said housing, (2) a nozzle assembly including a second valve for controlling dispensing of the pressurized gas, a nozzle for dispensing pressurized gas, and a nozzle assembly housing positioned around said second valve and said nozzle; and (3) a flexible hose in fluid communication with said second pressure regulator and said second valve, wherein said tank receiver removably receives said tank by mating of said regulator assembly and said valve assembly of said tank, such that, when said tank is empty, a new tank and valve assembly can replace the empty tank.

2. The body-worn balloon inflator of claim 1, wherein said nozzle assembly housing is ergonomic in shape.

3. The body-worn balloon inflator of claim 1, said pressurized gas within said tank having a pressure of between approximately 1000 and 5000 psi.

4. The body-worn balloon inflator of claim 1, said first pressure regulator reducing the pressure of said pressurized gas to less than 1000 psi.

5. The body-worn balloon inflator of claim 4, said second pressure regulator in said regulator assembly reducing the pressure of said pressurized gas to less than 150 psi.

6. The body-worn balloon inflator of claim 1, said regulator assembly further comprising an adapter secured to said valve assembly of said tank and said second pressure regulator of said regulator assembly, said adapter allowing for fluid communication between said valve assembly and said second pressure regulator.

7. The body-worn balloon inflator of claim 1, said regulator assembly housing having an opening to allow said hose to extend from said second pressure regulator to said second valve, said opening including a radiused circumferential surface to prevent flexing of the hose.

8. The body-worn balloon inflator of claim 1, said regulator assembly housing including one or more hose supports for reducing strain upon the hose.

9. The body-worn balloon inflator of claim 1, wherein the balloon inflator is devoid of a motor and air compressor.

10. The body-worn balloon inflator of claim 1, said second valve including an actuating mechanism for opening said second valve to dispense pressurized gas, said actuating mechanism extending through an aperture in said regulator assembly housing.

* * * * *